United States Patent [19]

Jellema et al.

[11] 3,973,667

[45] Aug. 10, 1976

[54] APPARATUS FOR VERTICALLY TRANSPORTING EGGS OR LIKE ARTICLES

[75] Inventors: Auke Jellema; Jelle van der Schoot, both of Aalten, Netherlands

[73] Assignee: Staalkat B.V., Aalten, Netherlands

[22] Filed: June 10, 1974

[21] Appl. No.: 478,069

[52] U.S. Cl. ..... 198/26; 198/51; 214/1 BD

[51] Int. Cl.[2] ..... B65G 47/00

[58] Field of Search ..... 198/50, 51, 68, 46, 198/49, 26, 20, 148, 149, 150, 145, 235, 246, 247, 72, 73, 74, 179, 153; 214/1 B, 1 BD

[56] References Cited

UNITED STATES PATENTS

| | | | |
|---|---|---|---|
| 1,901,042 | 3/1933 | Robbins | 198/179 |
| 3,342,012 | 9/1967 | Reading | 198/20 R |
| 3,528,572 | 9/1970 | Mosterd | 198/179 X |
| 3,592,327 | 7/1971 | Koch et al. | 198/251 |
| 3,627,102 | 12/1971 | Talbot | 198/26 |

FOREIGN PATENTS OR APPLICATIONS

| | | | |
|---|---|---|---|
| 959,161 | 5/1964 | United Kingdom | 198/26 |

*Primary Examiner*—Robert J. Spar
*Assistant Examiner*—James M. Slattery
*Attorney, Agent, or Firm*—Cushman, Darby & Cushman

[57] ABSTRACT

The invention relates to an apparatus for vertically transporting eggs or like articles comprising a plurality of vertically movable pairs of basket halves arranged side by side, the halves of each pair in the lowest position can rotate about horizontal shafts for dispensing or passing the egg or like article contained in each basket. In order to minimize the risk of rupture, of each pair of basket halves the one present at the discharge side of the carton has been made in the form of a resilient tongue. This is not only advantageous in that the eggs are resiliently received when falling into the basket, but also in that the cartons may be placed closely below the lowest position of the basket halves.

3 Claims, 5 Drawing Figures

APPARATUS FOR VERTICALLY TRANSPORTING EGGS OR LIKE ARTICLES

The invention relates to an apparatus for vertically transporting eggs or like articles comprising a plurality of vertically movable pairs of basket halves arranged side by side, the halves of each pair in the lowest position being adapted to rotate about horizontal shafts for dispensing or passing the egg or like article contained in each basket. Such apparatuses are used for supplying sorted articles to cartons.

When such an apparatus is used for packaging eggs, it is customary to to supply the eggs via a horizontal roller conveyor on which the eggs are present with their longitudinal axes in substantially horizontal direction. From the roller conveyor the eggs are received between two substantially vertical, converging plates, so that they are orientated, as was described in U.S. Pat. No. 3,126,993 in the name of Applicants. When the converging plates are moved apart, the eggs fall into the afore-mentioned baskets by means of which the eggs are supplied to the cartons.

It is an object of the invention to improve this known apparatus. According to the invention there is provided an apparatus for vertically transporting eggs or like articles comprising a plurality of vertically movable pairs of basket halves arranged side by side, the halves of each pair in the lowest position being adapted to rotate about horizontal shafts for dispensing or passing the egg or like article contained in each basket, characterized in that of each pair of basket halves the one present at the discharge side of the carton is formed by a resilient tongue. This is not only advantageous in that the eggs or the like are resiliently received thus minimizing the risk of rupture or damage, but also in that owing to the fact that such a tongue occupies little space the cartons may be placed immediately below the lowest position of the basket halves — it being even possible to reduce the height of fall to zero — without risking the preceding row of vertically transported products to be damaged.

The horizontal shafts about which the basket halves rotate may be adjustable relatively to each other, so that articles of different size may be received with a minimum height of fall.

Furthermore the pairs of transport baskets may be adjustable relatively to each other horizontally, so that the apparatus may be adapted to the package or to the size of the products to be transported.

One embodiment of the invention will now be described, by way of example, with reference to the accompanying drawings, wherein FIG. 1 is a side view of an apparatus for vertically transporting eggs;

According to the drawings an apparatus for vertically transporting eggs is provided with a horizontal supply conveyor rollers 2 over which eggs 3 are transported to an apparatus essentially consisting of two converging plates 4 and 5. When falling between said plates, the eggs are retained where their diameter is largest, and because their centers of gravity are below the lines connecting the points where they are retained between the plates, they turn their tips downwards, as was described in U.S. Pat. No. 3,126,993 in the name of Applicants.

Figure 1:
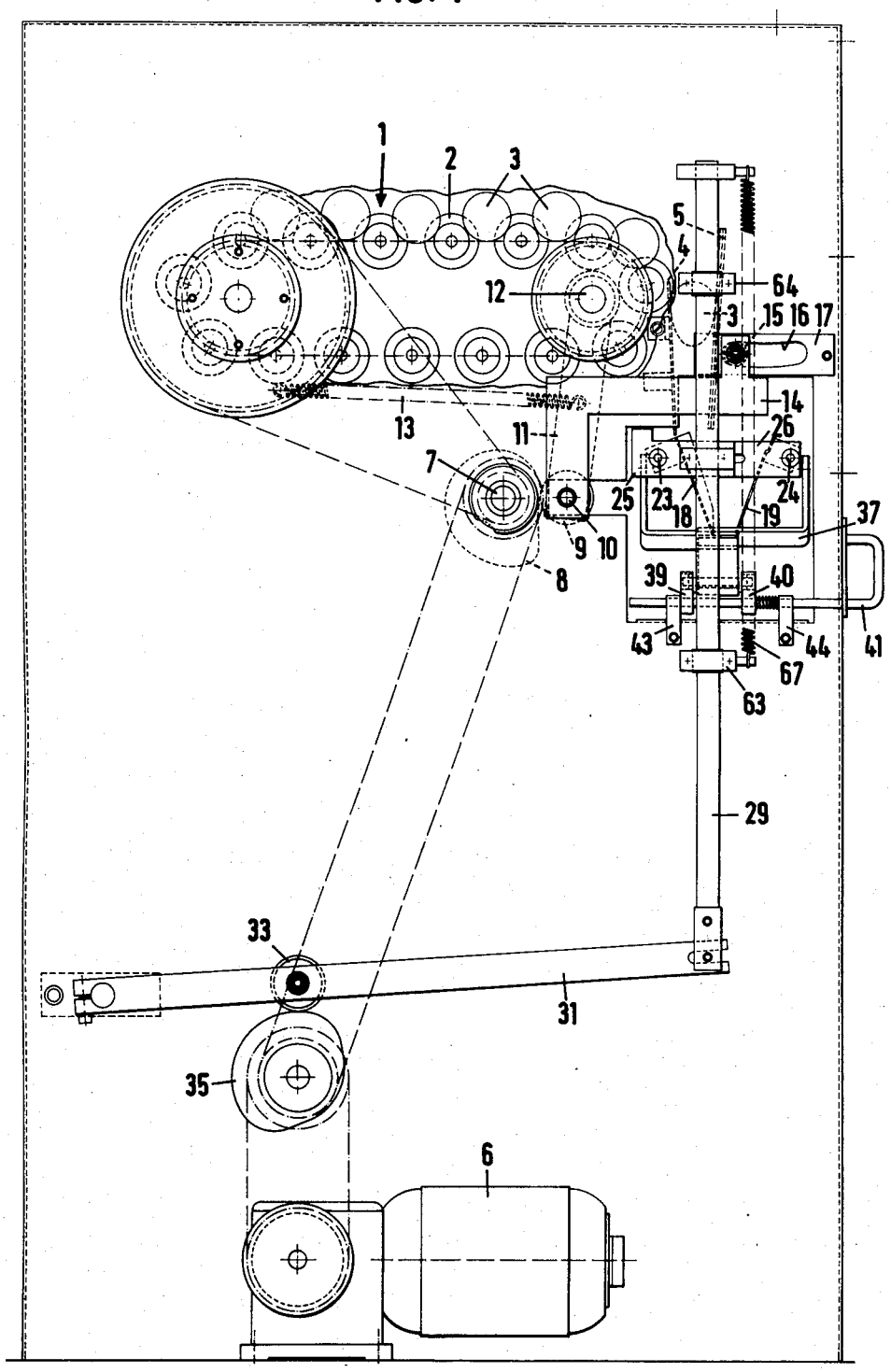

As is clearly shown in FIG. 1, the conveyor 1 is continuously driven by a motor 6 mounted on the frame of the apparatus via a plurality of transmission wheels and chains. On a shaft 7 of one of said transmission wheels there is mounted a cam disc 8 against which bears a roller 9 mounted on a shaft 10 which is supported by strips 11, the other ends of which are both freely rotatable about a shaft 12 of the conveyor 1. Roller 9 is kept in contact with cam 8 by means of a spring 13.

On shaft 10 there is furthermore attached a hook-shaped bridge piece 14, the other end of which supports a roller 15 which is movable in an arcuate opening 16 provided in a member 17 attached to the frame. To the bridge piece 14 there is furthermore attached plate 5 of the orientating apparatus. The operation of this part of the apparatus is as follows:

When the cam disc 8 is rotated, the bridge piece 14 will be moved forward and backward according to a parallelogram motion. The opening 16 has an arcuate configuration, because the bridge piece is mounted on shaft 12 via strips 11. Plate 5 of course follows the movement of the bridge piece 14, so that the eggs will move downwards between plates 4 and 5 in orientated position and subsequently fall into a plurality of baskets arranged side by side, each consisting of two halves 18 and 19.

The basket halves 18 and 19 are attached to bows 20 and 21, which are mounted on shafts 23 and 24 respectively with interposed spacer sleeves 22. In order to effect the correct movement, as will be set out in more detail hereafter, the basket halves are furthermore coupled by means of shaft 49 and 50 which are fixedly interconnected and connected with shafts 23 and 24 by means of strips 51 and 52 respectively. At their ends shafts 23 and 24 are provided with securing strips 25 and 26, by means of which the basket halves may be adjusted relatively to each other in dependence on the size of the eggs to be transported. Strips 25 and 26 also serve for attachment to blocks 27 and 28 which are fixedly mounted on vertical shafts 29 and 30 received in bearings 63, 64 and 65, 66 fixedly attached to the frame.

After having received the eggs, the baskets are moved not only downwards, but also simultaneously towards each other, so that the eggs can be received in vertical position in the carton with smaller interspaces.

The vertical movement of the basket halves is effected by that of shafts 29 and 30. The movement of these shafts is effected by means of levers 31 and 32 provided with rollers 33 and 34 which coact with cam discs 35 and 36 driven from the motor 6. The rollers are pressed in contact with the cam discs by means of a spring 67.

In order to move the basket halves towards each other, the two outer basket halves are each connected with a crank 37, 38, the other ends of which are pivoted about a fixed point. When the basket halves are moved downwardly, they will be forced towards each other by cranks 37 and 38. When the basket halves are moved upwardly, they will be brought again at the proper interspace required for receiving the eggs supplied via plated 4 and 5 by means of the above-mentioned spacer sleeves 22.

Figure 2:
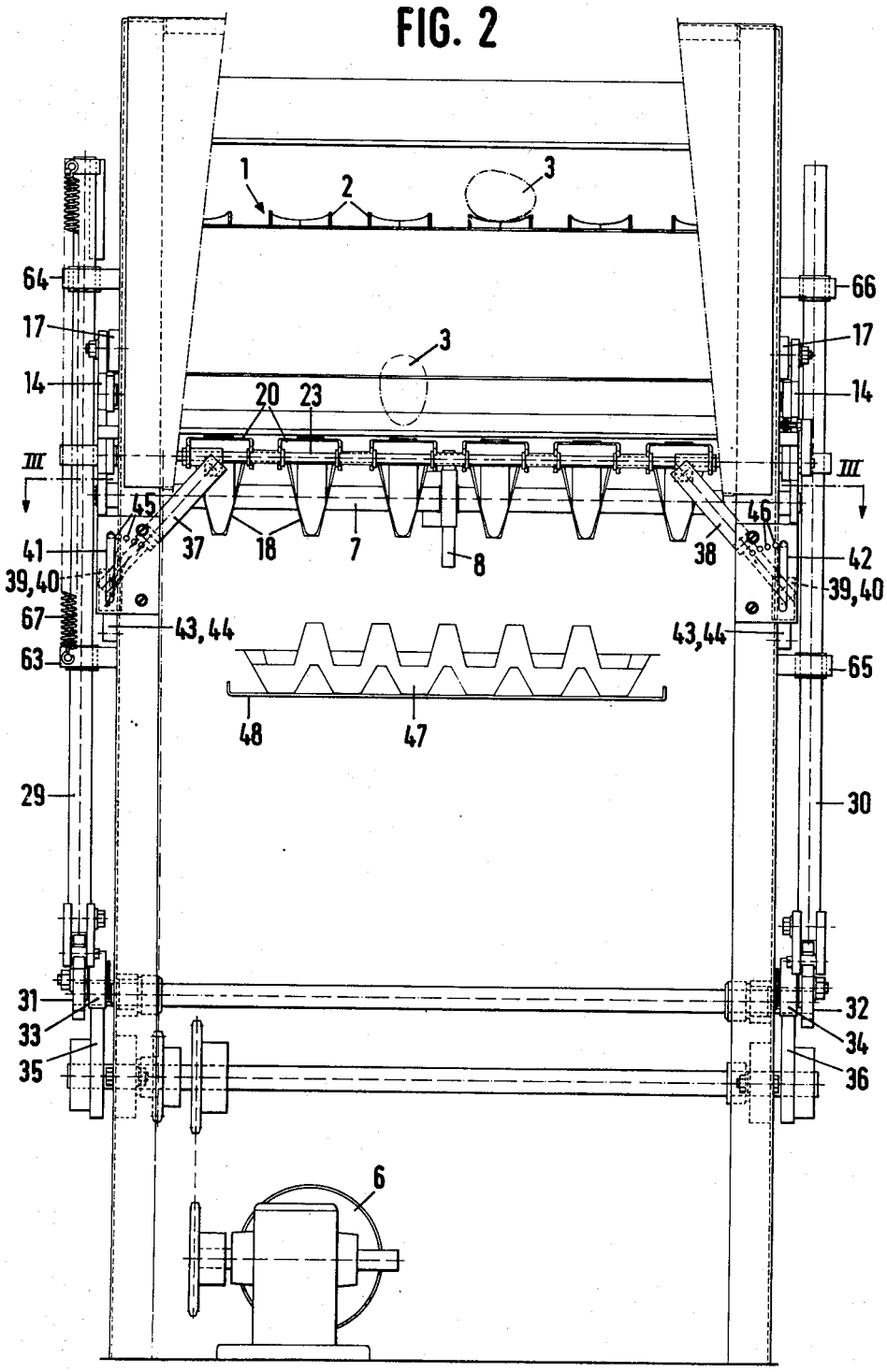
FIG. 2 is a front view of the apparatus shown in FIG. 1 with some parts partly broken away.
Figure 3:
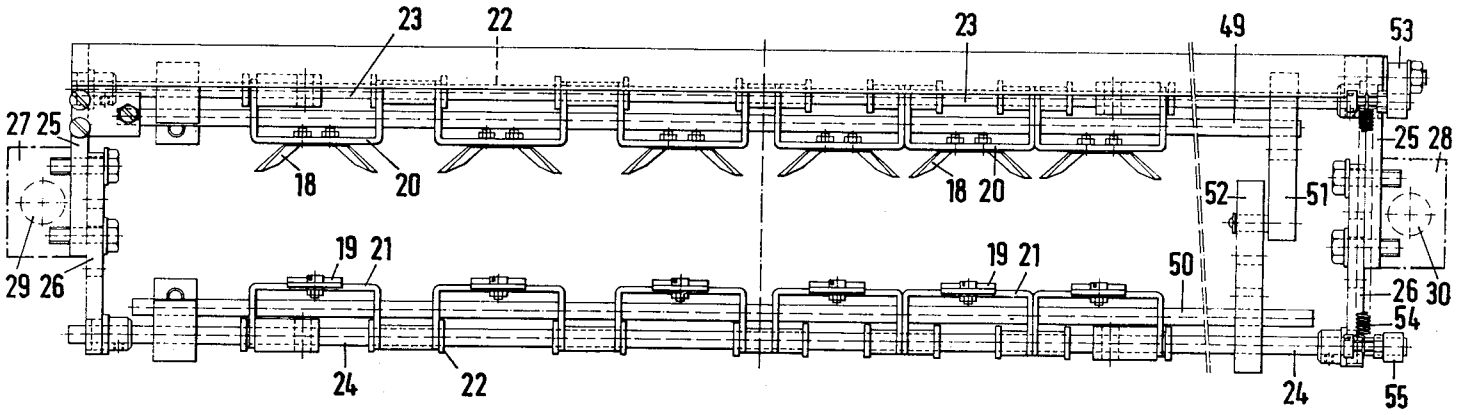
FIG. 3 is a top view of the vertical transport portion on the line III—III in FIG. 2, in the left-hand part of which Figure the transport baskets are shown spaced apart and in the right-hand part adjoining.

In order to be able to adapt the horizontal distance between the basket halves to the package used, the pivots of cranks 37 and 38 are made adjustable. For this purpose the pivots are each formed by a shaft fitted in plates 39 and 40 (FIGS. 1 and 2), which plates are adjustable by means of grips 41, 42 (supported in bearings 43 and 44) that are operable from the outside, and for which purpose there are present a plurality of adjusting openings 45 and 46.

After having been moved downwardly, the baskets are opened and the eggs are dropped into an egg carton 47 placed on a schematically drawn conveyor 48.

Figure 4:
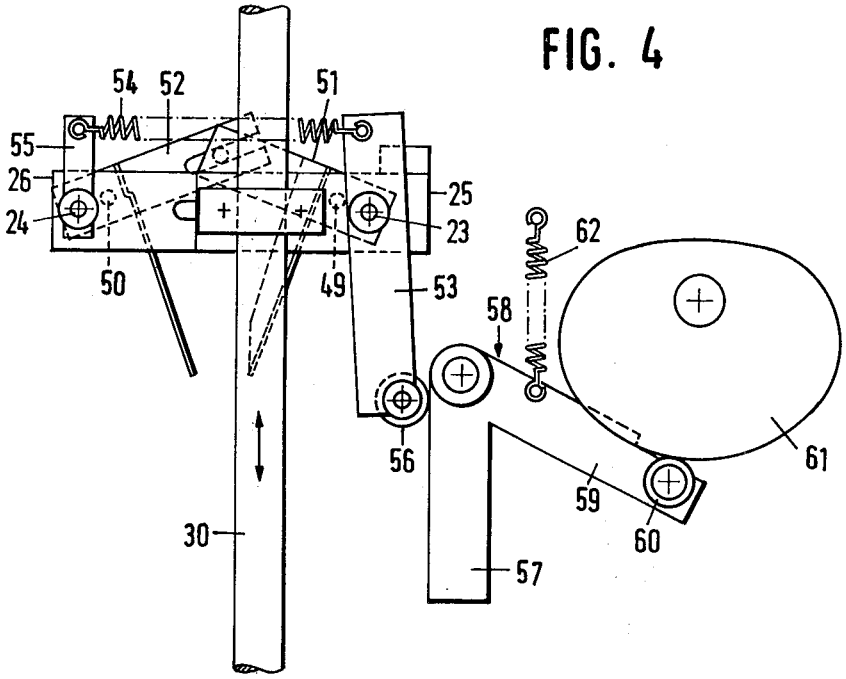
FIGS. 4 and 5 give on a reduced scale a detail of the apparatus according to FIGS. 1–3 showing the manner in which the transport baskets are opened and closed.
Figure 5:
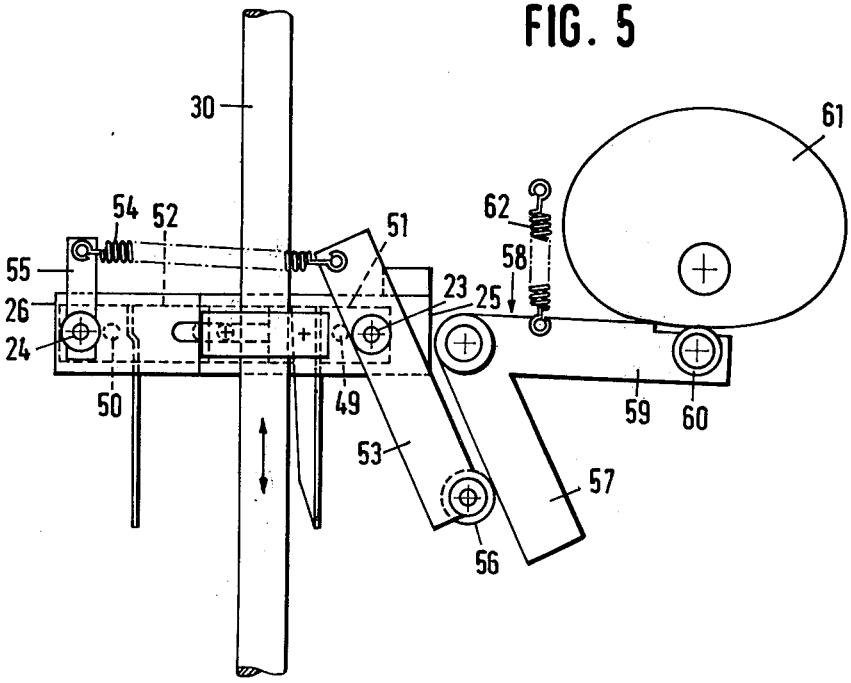

In order to open and close the basket halves (see in particular FIGS. 4 and 5) there is fixedly connected with shaft 23 a lever 53, the one end of which is connected via a spring 54 with a lever 55 fixedly connected with shaft 24, while the other end of lever 53 carries a roller 56 which abuts against an arm 57 of a tilting lever 58, the other arm 59 of which carries a roller 60 which follows a cam disc 61. Roller 60 is kept in contact with the cam disc by means of a spring 62. It will be clear that the desired opening and closing movement of the coupled basket halves can be obtained by choosing a cam disc 61 having a suitable configuration.

By choosing a suitable configuration of cam disc 61 and by making one basket halve, in this case the one indicated by 19, as a resilient strip, it is rendered possible to bring the basket halves into or to very closely above the egg carton prior to opening the baskets, while the baskets may be closed again after the basket halves have been moved to a safe distance above the delivered eggs. It will be clear that basket halve 19 made as a resilient strip should be present at the side of the eggs delivered during the preceding movement cycle. Therefore, the use of such a resilient strip is not only advantageous in that the eggs are resiliently received in the baskets, but also in that they may be moved completely or substantially completely into their locating nests in the carton.

The above-described apparatus is suitable for continuous operation, but it will be obvious that the apparatus as a whole, or parts thereof, may also be made for discontinuous operation.

Finally, it is observed that a great number of modifications are possible within the scope of the inventive idea.

We claim:

1. An apparatus for vertically transporting eggs or like articles, comprising:

a plurality of horizontally aligned basket means, each basket means consisting of first and second separate and spaced basket half members, all of the first basket half members being rotatable about a first horizontal shaft in a lower position and all of the second half members being similarly rotatable about a second horizontal shaft parallel to and horizontally spaced from the first shaft, for dispensing the egg or like article into a carton, all of either the first or second basket half members being formed by resilient tongue means resiliently receiving and holding the egg for movement between an upper position and the lower position and for permitting the eggs to be substantially completely inserted into the carton prior to releasing the eggs; and means for simultaneously vertically moving said plurality of basket means between said upper position wherein each basket is capable of receiving an egg or like article from a distribution source and said lower position wherein each basket is disposed above the carton or the like being filled and for simultaneously rotating all of said first and second basket half members about said first and second shafts so as to release said eggs or like articles in each said basket means into said carton.

2. An apparatus as claimed in claim 1, characterized in that the horizontal shafts about which the basket half members rotate are adjustable relatively to each other, so that articles of different size may be received.

3. An apparatus as defined in claim 1, wherein the plurality of basket means are horizontally movable relative to each other from an expanded position at the upper vertical position of the baskets to a contracted position at the lower vertical position of the baskets.

* * * * *